US008117722B2

(12) United States Patent
Foroni

(10) Patent No.: US 8,117,722 B2
(45) Date of Patent: Feb. 21, 2012

(54) CONTAINER AND CLOSURE DEVICE EMPLOYABLE IN ASSOCIATION WITH SAID CONTAINER

(76) Inventor: Ida Foroni, Varese (IT)

( * ) Notice: Subject to any disclaimer, the term of this patent is extended or adjusted under 35 U.S.C. 154(b) by 209 days.

(21) Appl. No.: 12/305,917

(22) PCT Filed: Jun. 26, 2007

(86) PCT No.: PCT/IB2007/001964

§ 371 (c)(1),
(2), (4) Date: Apr. 21, 2009

(87) PCT Pub. No.: WO2008/001215

PCT Pub. Date: Jan. 3, 2008

(65) Prior Publication Data

US 2010/0237141 A1 Sep. 23, 2010

(30) Foreign Application Priority Data

Jun. 27, 2006 (IT) ..... MI2006A1238

(51) Int. Cl.
*A44B 17/00* (2006.01)

(52) U.S. Cl. ..... 24/704.1; 24/453

(58) Field of Classification Search ..... 24/453, 24/297, 704.1; 411/508–510
See application file for complete search history.

(56) References Cited

U.S. PATENT DOCUMENTS

| | | | | |
|---|---|---|---|---|
| 2,845,976 | A | 8/1958 | Miller | |
| 3,227,266 | A | 1/1966 | Soma | |
| 3,494,458 | A | 2/1970 | Meierhoefer | |
| 3,890,680 | A * | 6/1975 | Furuya | 24/614 |
| 6,412,153 | B1 * | 7/2002 | Khachadourian et al. | 24/614 |
| 6,578,240 | B2 * | 6/2003 | Fortenberry | 24/67 R |
| 7,240,406 | B1 * | 7/2007 | Liverman et al. | 24/614 |
| 7,480,968 | B2 * | 1/2009 | Maresh et al. | 24/453 |

FOREIGN PATENT DOCUMENTS

| | | |
|---|---|---|
| DE | 23 08 968 A1 | 9/1974 |
| DE | 296 06 477 U1 | 7/1996 |
| GB | 1 185 475 A | 3/1970 |
| GB | 2 311 515 A | 10/1997 |

* cited by examiner

*Primary Examiner* — James Brittain
(74) *Attorney, Agent, or Firm* — Pearne & Gordon LLP

(57) ABSTRACT

A container is realisable by folding a laminar element (10), and the laminar element comprises: mutually adjacent principal faces (20), connected to each other by principal folding lines (30), the principal faces extending along a principal axis (20*a*) and presenting respectively principal sides (20*b*) parallel to the principal axis and located respectively at a first (20*c*) and a second distance (20*d*) from the latter; auxiliary faces (40) emerging from each principal face along respective second axes of extension (40*a*) orthogonal to the principal axis and connected to the principal faces by auxiliary folding lines (50). For at least one pair of principal sides of at least one principal face, the first and the second distance are different in value, the principal sides of a principal face presenting a respective offset (60), transverse with respect to the principal axis and different, for each principal side, with respect to an ideal mid-line of the principal face to which they belong.

16 Claims, 11 Drawing Sheets

CONTAINER AND CLOSURE DEVICE EMPLOYABLE IN ASSOCIATION WITH SAID CONTAINER

Figure 1A:
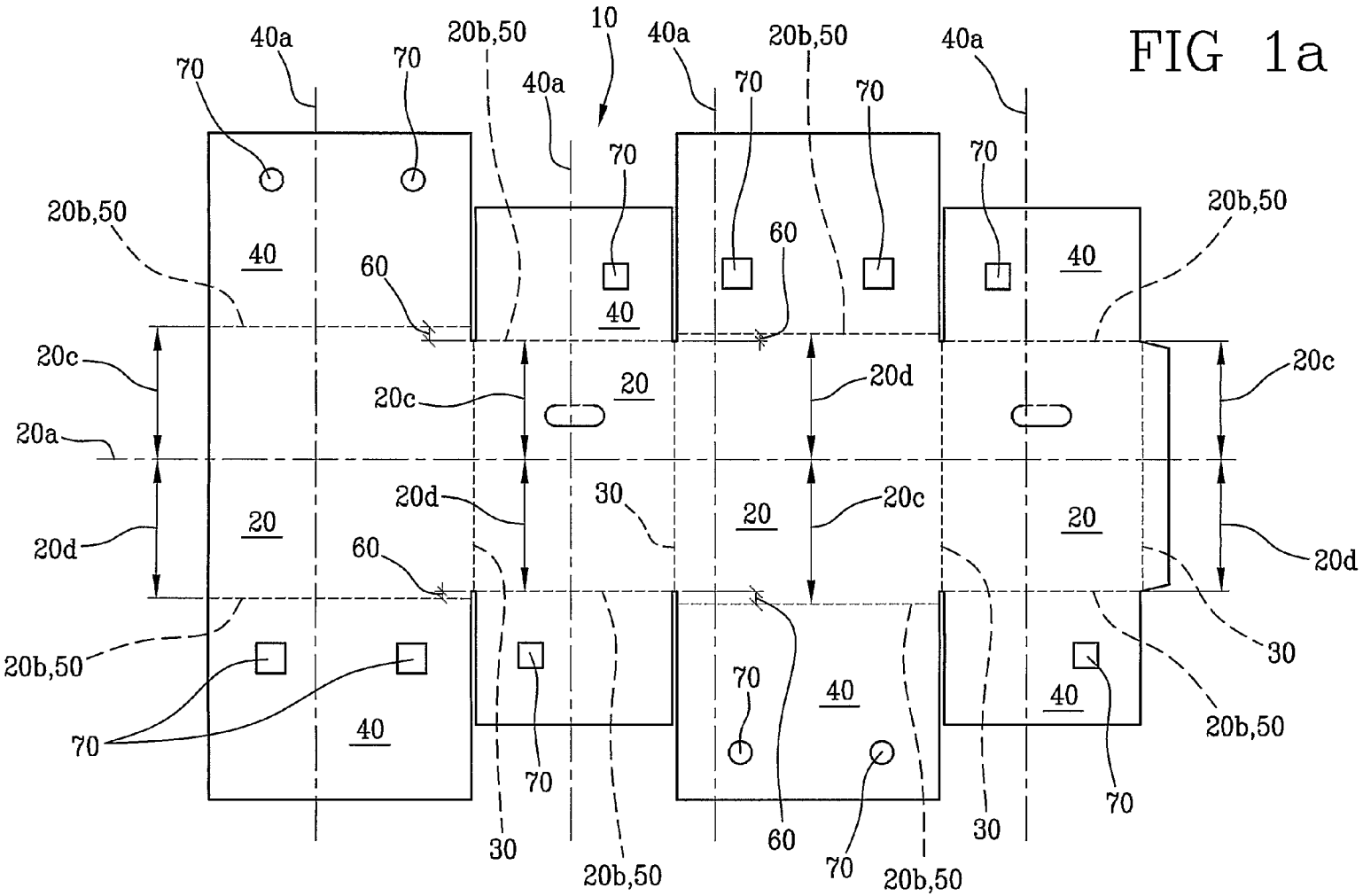
Figure 1B:
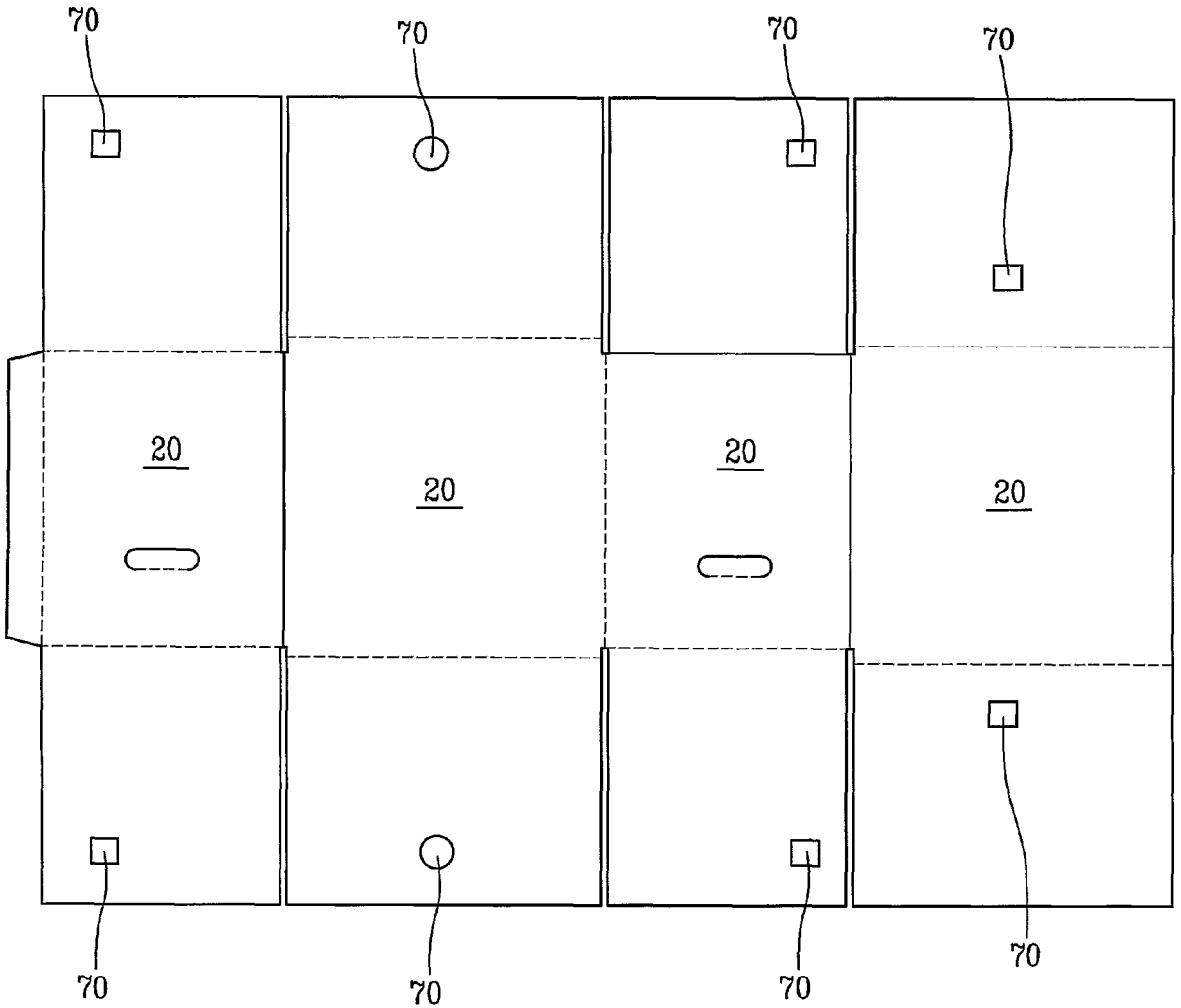
Figure 1C:
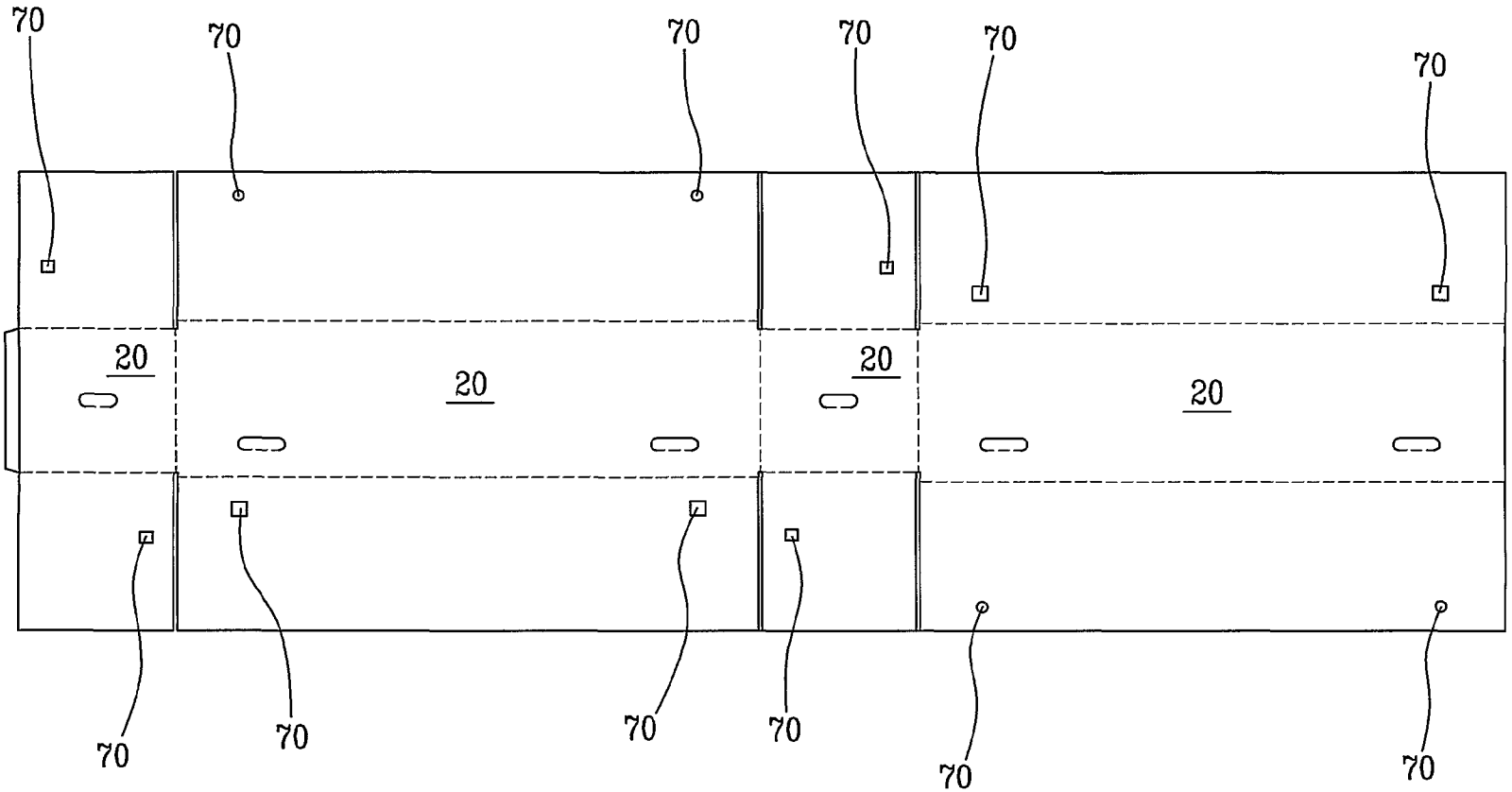

The subject of the present invention is a container for logistical use, as well as a closure device for said container.

As is well-known, in many applications in transport and/or storage of products (of the most disparate nature), box-type containers in cardboard are used: these containers are usually made by starting from a flat 'sheet' of single-ply or multi-ply cardboard, which in a preliminary stage is cut into a geometrical shape which will then be folded along suitable lines to form an operating volume within which the objects to be handled may be put.

Generally, the pre-cutting operations (also known as blanking operations) form a flat shape which results from the geometrical development of an ideal cube or paralleliped, and may possibly require the partial or total superimposition of two or more flaps which go to form a given face of said ideal cube or paralleliped.

After blanking out the cardboard and suitably folding it, it is often necessary then to close the container. It should be noted in this connection that in the field of logistics, the closure of a container does not simply have the function of closing the volume for transport or storage, but can also serve the function of 'sealing' the contents, in order for example to guarantee that the contents are not illicitly removed.

Again in the field of logistics, it is often necessary to 'track' the actual position of the container in real time, along its route from the sender to the addressee: typically, this requirement is met by affixing appropriate bar-codes to the container, which are read by the various stations in the logistical chain in such a way as to 'record' the passing of the container itself.

Alternatively, the container can be remotely followed en route by means of a GPS-based locating system, which can be directly attached to the container or the vehicle which is transporting a plurality of them.

The various techniques currently employed, widely used though they are, have some considerable disadvantages.

In the first place, already at the stage of blanking and folding the cardboard sheets, it is not uncommon to encounter poor quality in the mating of the flaps and in the effective elimination of possible gaps between one flap and another: this is particularly frequent with particularly thick cardboard sheets, which among other things are particularly demanding in terms of production costs and the force required to effect the correct folds.

It should also be observed that imperfect closure of the folded cardboard container allows thieving equipment to be very easily inserted, or indeed can allow the box itself to be manually forced, with obvious safety risks for the conservation of the goods which are being transported.

Furthermore, it should be noted that even recent technologies for tracking containers along their route are substantially unsatisfactory from the point of view of security and/or reliability.

For example, it is very probable that the labels with the bar-codes will be removed from the containers and that they will be, so to speak, 'delivered' to the various intermediate logistical stations: in this way the operations centre still receives the data relating to the passage of the goods, which however have now been physically separated from the bar-code itself.

Moreover, besides the more or less voluntary removal of the label, tracking devices based on reading a bar-code present other inefficiencies due to the fact that, in order to be read, the codes must be very close and, above all, visible to the relative reader: this limits the operational possibilities and is anyway revealed as unsatisfactory if, for example, operations take place in a dusty environment or where several containers are assembled together in such a way as to obscure one or more of one another's faces.

Also, tracking devices based on the use of magnetic strips have disadvantages connected with the legibility of the magnetic strips themselves: in fact, although it is possible to position these strips so that they are not visible, there remains a constraint resulting from the fact that in order to work, magnetic strip readers must be extremely close to the magnetic strips themselves.

Besides, even techniques which make use of GPS-based tracking systems are not completely reliable, given the possibility of removing one or more of the containers from the monitored vehicle, and also given the high cost entailed by the extensive use of an individual system for each single container moved.

An object of the present invention is to create a container for logistical use, as well as a closure device employable in association with said container, capable of obviating the disadvantages just presented.

In particular, the present invention aims to devise a container easily obtainable from a cardboard sheet, even multiply of considerable thickness, and in particular a container which guarantees a perfect closure and superimposition of its flaps, as well as perfect homogeneity and geometrical continuity of its external surface.

Furthermore, the present invention has as its object the devising of a closure device employable in association with a container which enables effective security to be guaranteed, unmistakably identifying any attempts at forcing, and at the same time ensuring a high level of ergonomic efficiency and equally great ease of manipulation.

Again, an aim of the present invention is to create a closure device which can be equipped, with a few technical expedients and at low cost, with any possible advanced functionalities for 'tracking' in real time the container on which it is installed.

Figure 2A:
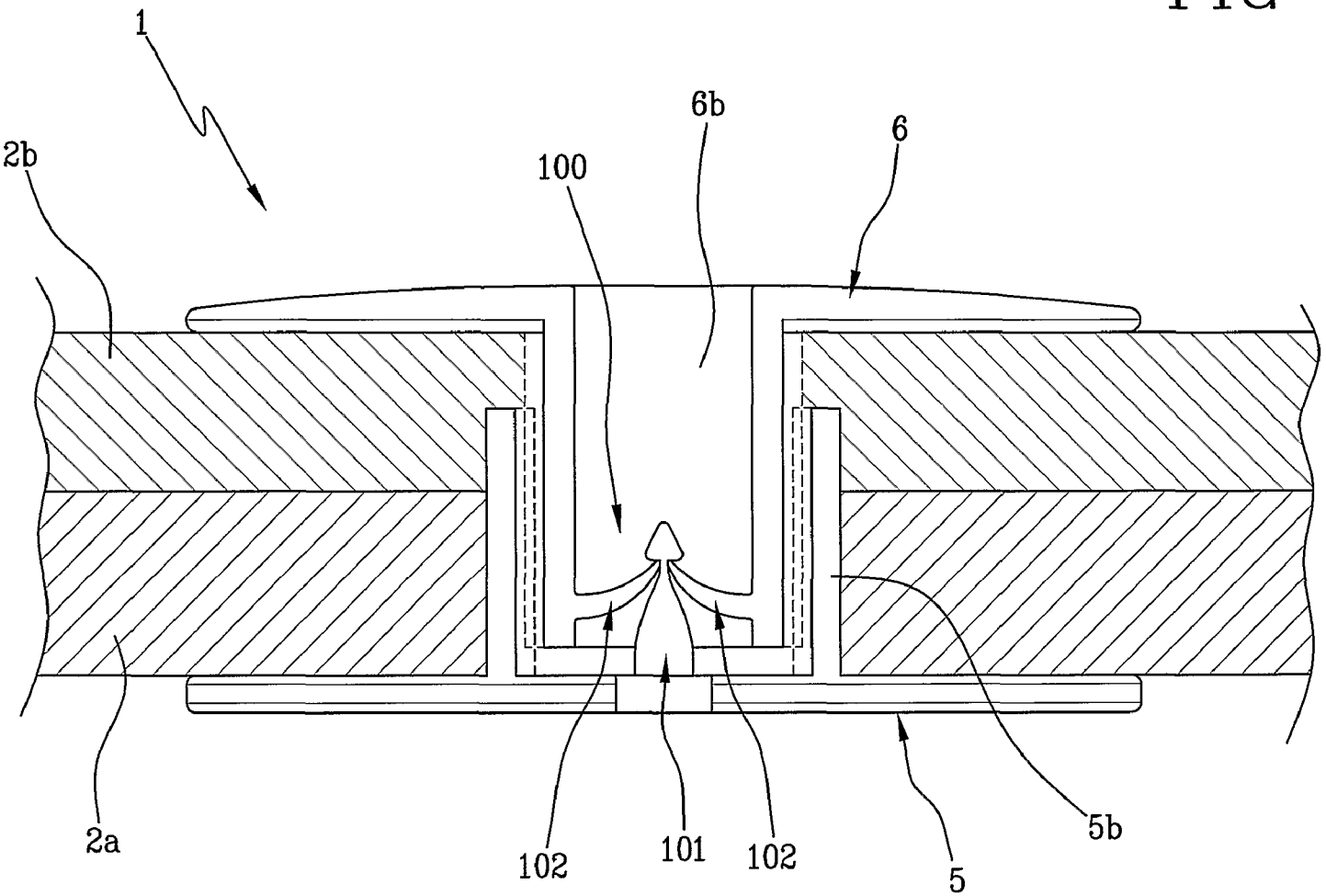
Figure 2B:
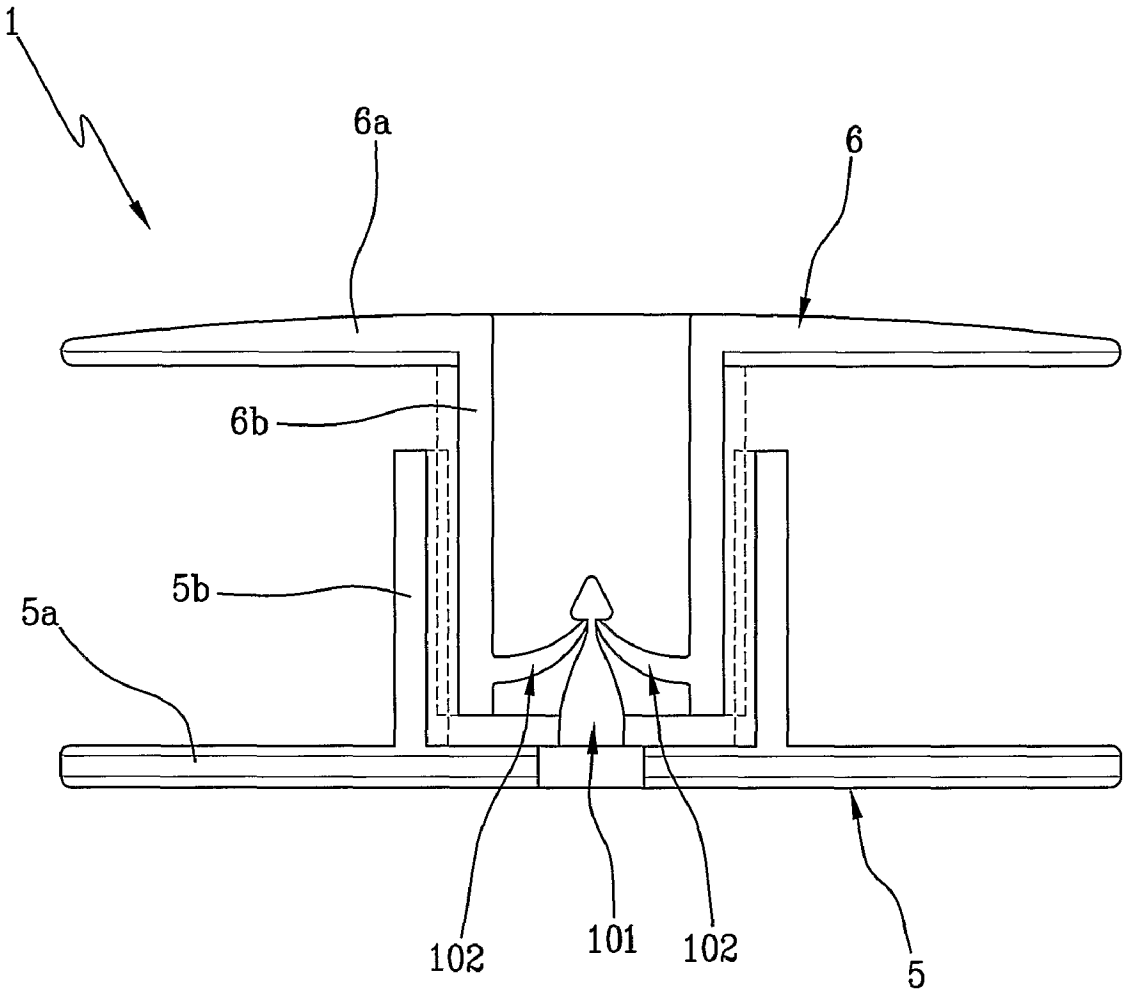
Figure 2D:
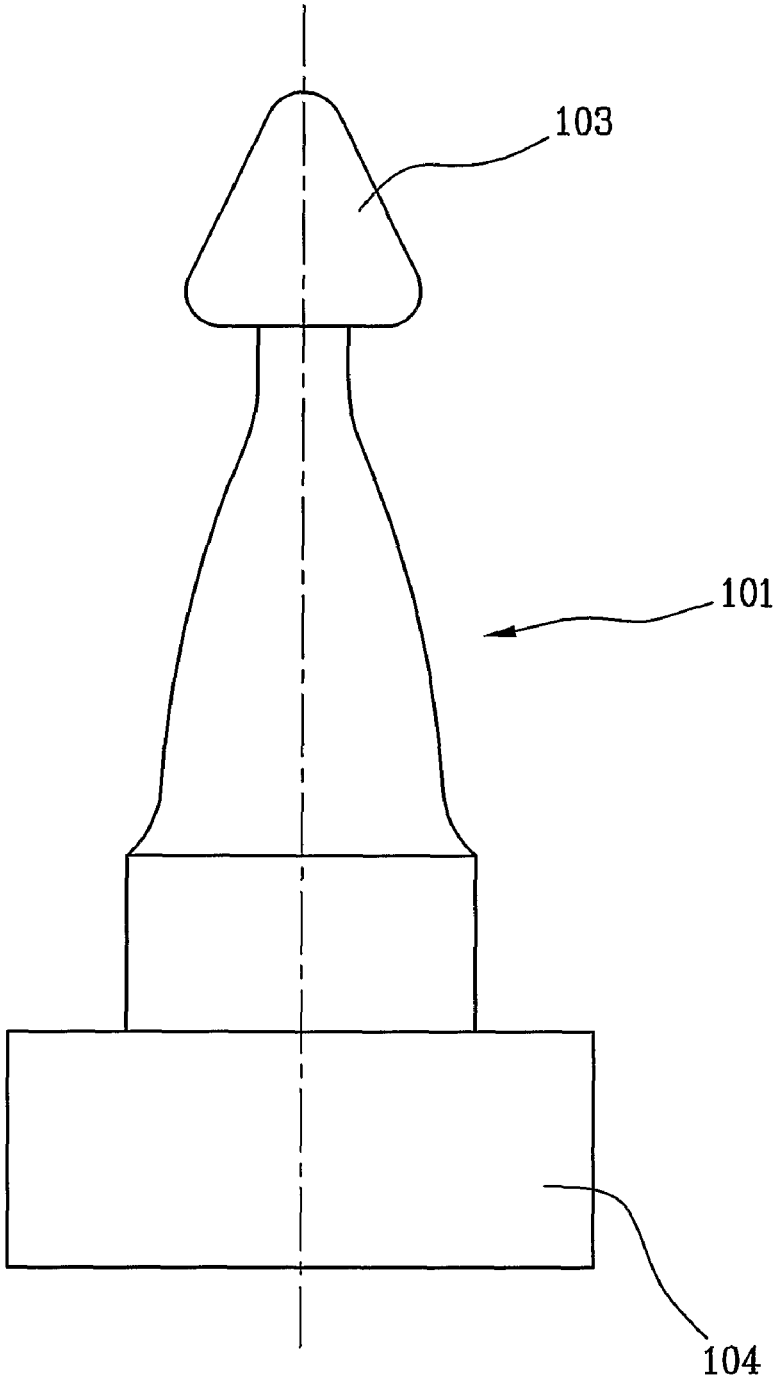
Figure 2C:
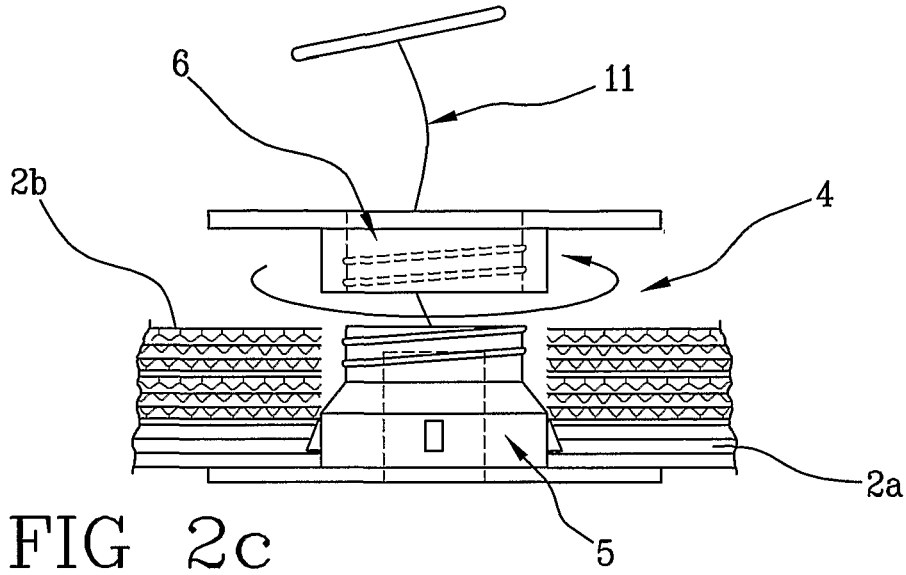

These and other objects are achieved by a container for logistical use, as well as by a closure device employable in association with a container, in accordance with the present invention, having the characteristics set forth in the accompanying claims and illustrated below in their respective exemplary, but not therefore limiting, embodiments, and also in the attached drawings, in which:

FIGS. 1*a*, 1*b*, 1*c*, 1*d*, 1*e* and 1*f* show plan views of several variant embodiments of a laminar element blanked and ready to be folded to form a container in accordance with the present invention;

FIGS. 2*a*, 2*b* and 2*c* show views in section of an assembly device employable in association with a container in accordance with the invention;

FIG. 2*d* shows a schematic view of a component illustrated in FIGS. 2*a* and 2*b;*

Figure 3:
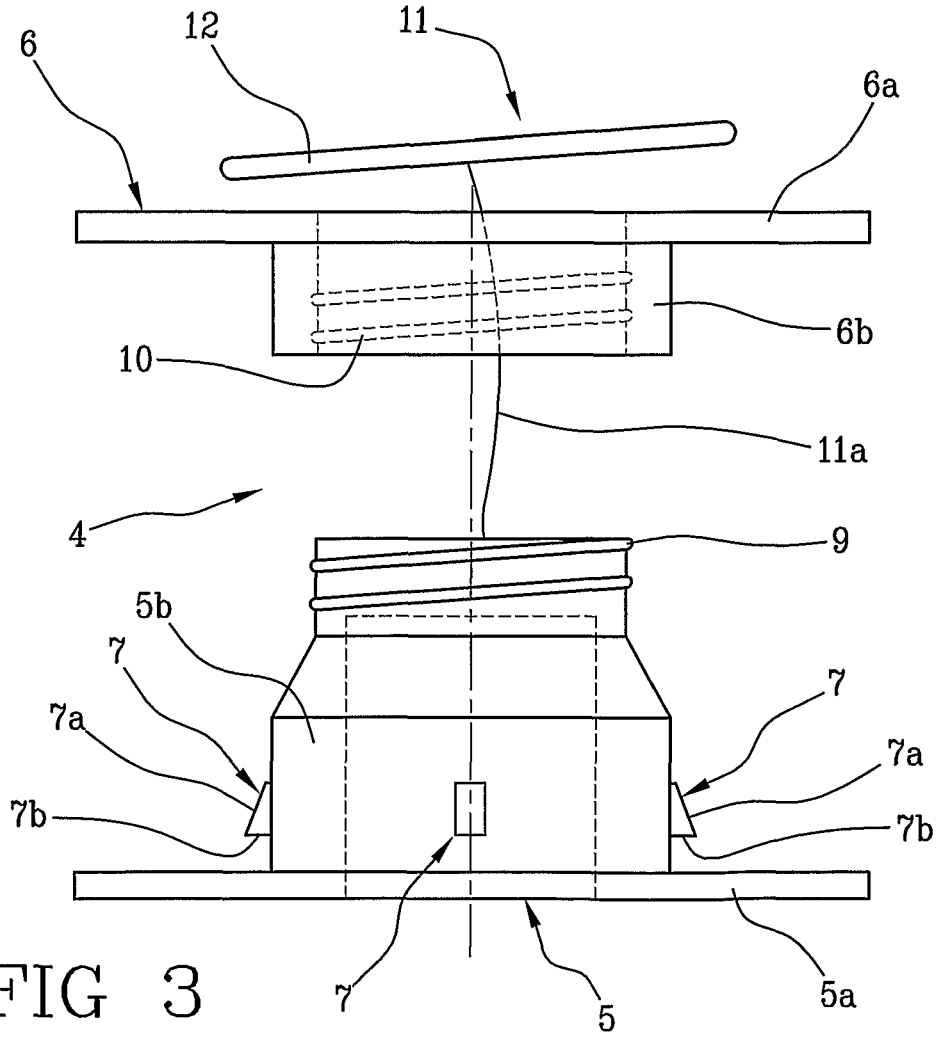
Figure 4:
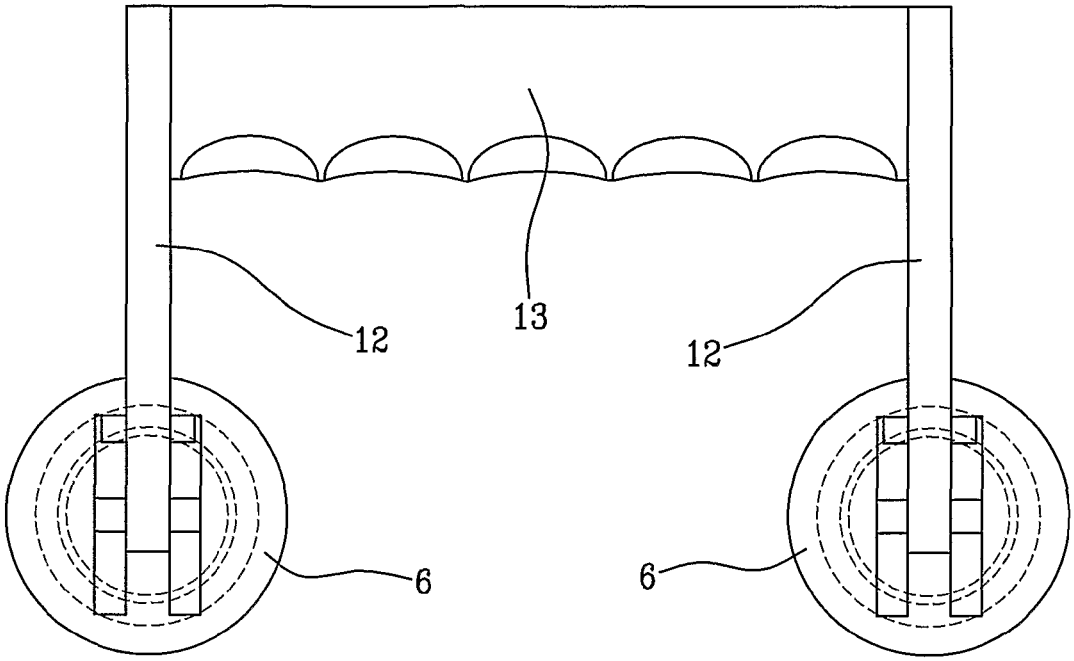
Figure 5:
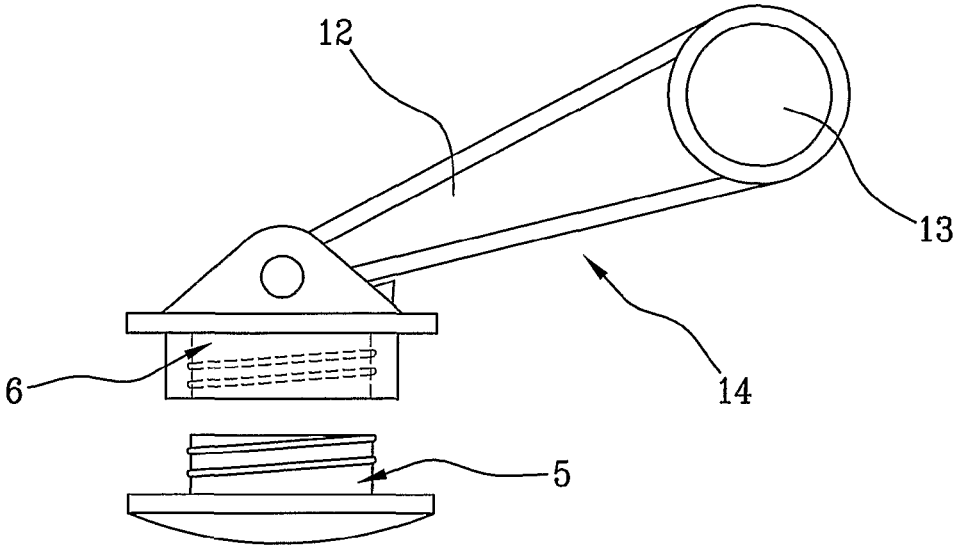

FIG. 3 shows a view in section of the device shown in FIGS. 2*a* and 2*b* in conditions of association with two flaps of the blanked laminar element shown in FIG. 1; and FIGS. 4 and 5 show schematic views of possible variant embodiments of the assembly device according to the invention.

With reference to the attached drawings, the container according to the invention is advantageously realisable by folding a laminar element 10 (which can be in multi-ply cardboard or also in other materials, according to the needs of the moment).

In its turn, laminar element 10 includes a predetermined number of principal faces 20, mutually adjacent and connected to each other by principal folding lines 30: these principal faces 20 extend along a principal axis 20*a* and present respectively at least two principal sides 20*b* parallel to the principal axis 20*a* and located respectively at a first distance 20*c* and at a second distance 20*d* from the principal axis 20*a*.

Also present are auxiliary faces 40 respectively emerging from each principal face 20 along respective second axes of extension 40*a*, transverse (for example orthogonal in the exemplary drawings) to principal axis 20*a*: these auxiliary faces 40 are connected to the principal faces 20 by auxiliary folding lines 50, which conveniently can correspond to the principal sides 20*b*.

Advantageously, for at least one pair of principal sides 20*b* (and more generally, for each pair of principal sides 20*b*) of at least one principal face 20 (or in the principal case, of all the principal faces 20), the just mentioned first distance 20*c* and second distance 20*d* are different in value: in other words, each of the principal sides 20*b* of a principal face 20 presents a respective transverse offset 60 with respect to the principal axis 20*a* which is not equal (i.e. is different for each side) with respect to an ideal centre line of the principal face 20 to which they belong.

It should be noted that the 'asymmetrical offset' layout just explained allows for account to be taken, during folding of the laminar element 10, of the 'filling' effect caused by the thicknesses of the auxiliary sides: in other words, the present invention has devised a particular way of conforming adjacent principal faces 20 in such a way that, by acting first on folds 30 and then superimposing auxiliary faces 40 by acting on folds 50, this superimposition itself will occur in a perfectly coplanar manner, since the axes of relative rotation of the auxiliary faces will be offset by just the right amount (while still being mutually parallel) and mechanical interference will not then occur at the moment of folding.

As already stated in advance above, laminar element 10 can be made in is cardboard, preferably multi-ply: this laminar element 10 will therefore have a predetermined thickness S and consequently it is advantageously possible to quantify the transverse offset 60 (or, better, it is possible to quantify one or more values for offset 60), in such a way that it is at least equal in value to this thickness S or to a predetermined whole-number multiple of S.

Coming down to the detail of FIG. 1, it may be seen that the principal sides 20*b* of successive principal faces 20 along principal axis 20*a* present respectively values for transverse offset 60 alternating along their respective principal sides 20*b* located in identical half-spaces ideally bounded by the principal axis 20*a*.

More particularly, in FIG. 1 we may note a succession of values for offset (in an identical half-space with respect to axis 20*a*) which alternate between a lower value equal to one thickness S and an upper value equal to two thicknesses S: in this way, account is taken of the fact that during the folding of the laminar element 10 there occur, on opposite sides of the container, alternate superimpositions of two and three auxiliary faces 40.

Conveniently, if only two faces are superimposed, the offset required will be equal to a single thickness S, while if three faces are superimposed, the offset required will be equal to two thicknesses S.

Generalising, it may indeed be seen that if the folding of the laminar element provides for the (partial or total) superimposition of N auxiliary faces, the offsets of the principal faces from which these faces emerge will equal (N−1) thicknesses S.

In order to facilitate assembly, transport and especially the superimposition of the faces and their mutual stabilisation, there is present a predetermined number of housings 70 formed in the principal faces 20 and/or the auxiliary faces 40: these housings 70 are capable of being at least partially engaged by an assembly device 1 (which will be explained in greater detail below) and are conveniently positioned in such a way as to be superimposed following folding of the laminar element 10, so as to form a single insertion area for assembly device 1 itself. According to the needs of the moment, the principal faces and the auxiliary faces can vary, both in terms of dimensions and of number, for example with the addition and/or the elimination of one or more faces.

For example, gluing tongue 21 can be eliminated, without for this reason reducing the stability and containment efficiency of the container obtained by folding.

On the other hand, according to another aspect of the present invention, there can be present at least one transverse extension 22 comprising a plurality of mutually connected auxiliary faces.

This transverse extension 22 can have a length at least equal to the transverse perimetral extent of the container in assembled condition: in other words, the transverse extension 22 is shaped (either according to a sequence of faces interconnected through folding lines, or even according to a single element in sheet that can be bent in arbitrary manner and/or without loss of continuity) in such a way as to encircle the container along one of its transverse sections.

Figure 1D:
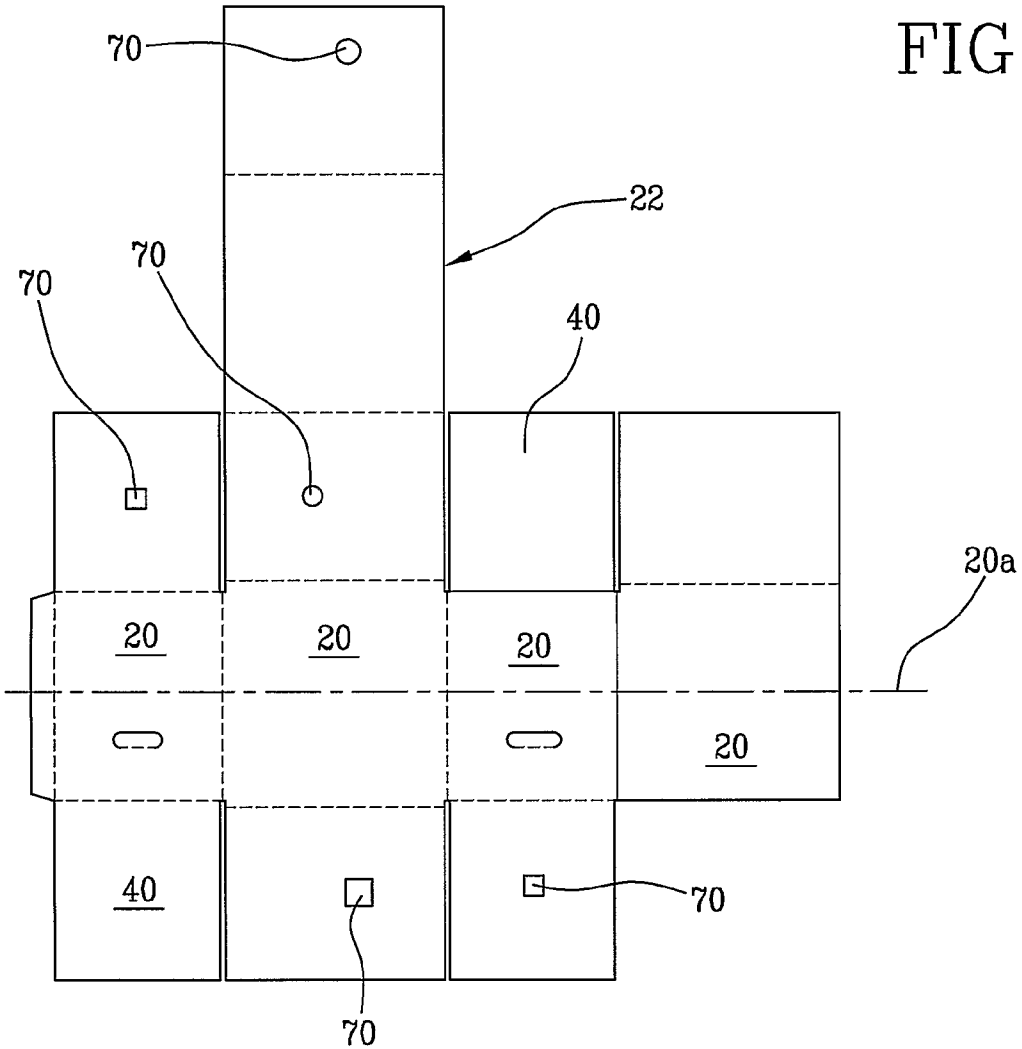
Figure 1E:
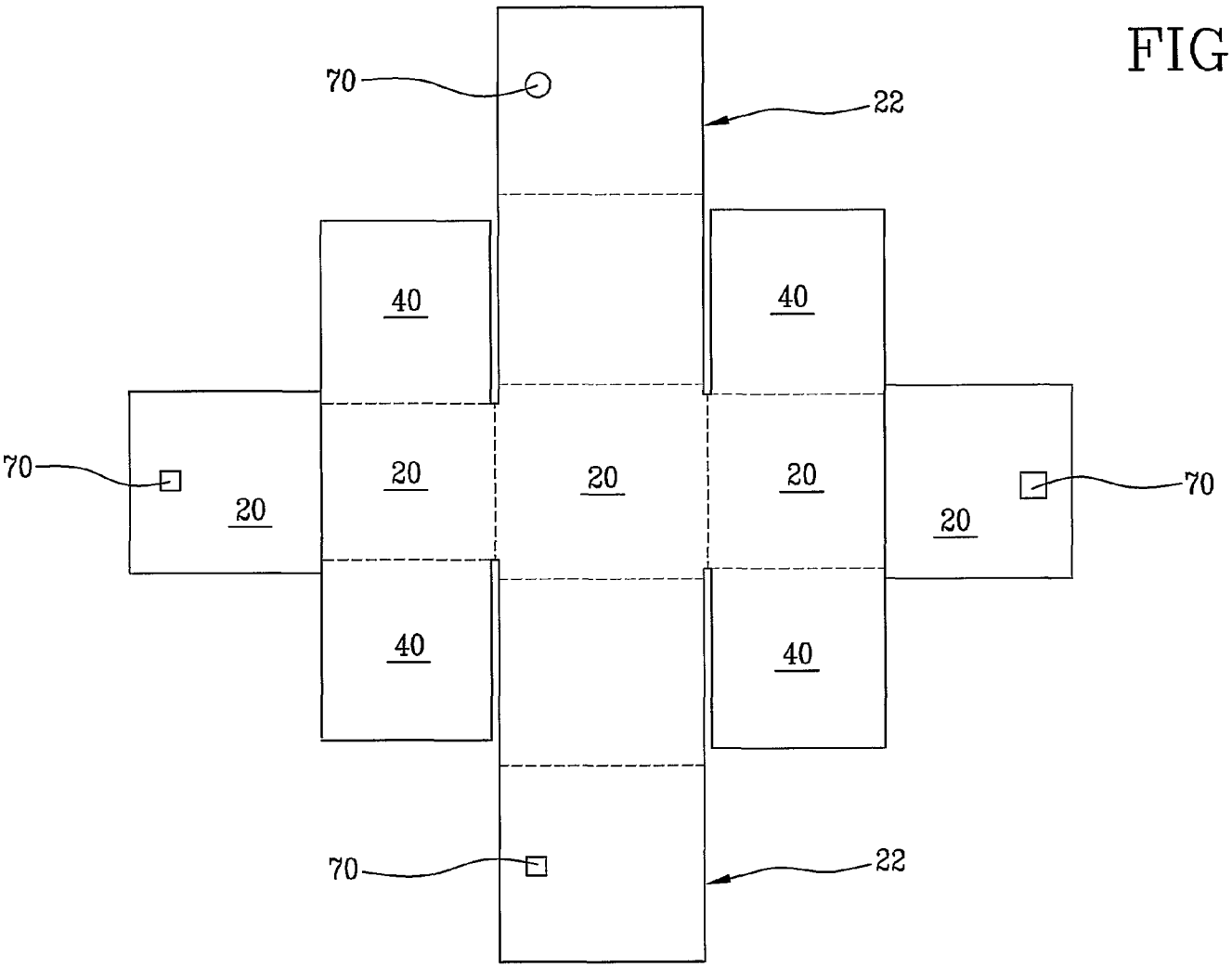
Figure 1F:
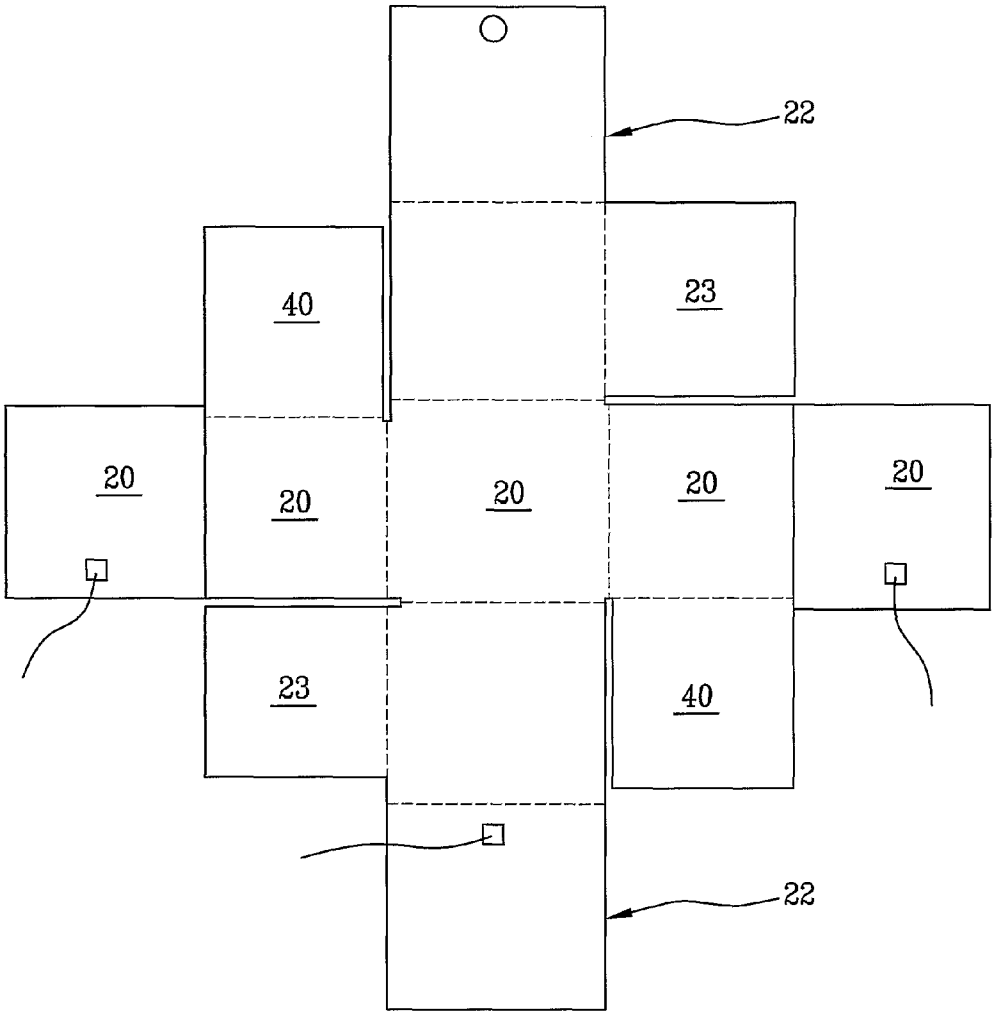

Thanks to the presence of transverse extension 22, and thanks to a suitable arrangement of housings 70, it is possible to minimise the number of closure is devices required to form the 'operating' shape of the container: for example in FIGS. 1*d* 1*e* and 1*f*, an extremely low number of housings may be noted, which in conditions of superimposition of the various faces and flaps are aligned with each other, and therefore enable the insertion of a single common closure device.

The variant embodiments shown in FIGS. 1*e* and 1*f*, however, show two transverse extensions 22, which emerge in opposite half-spaces with respect to the principal axis 20*a* and which are anyway capable of at least partially encircling the container along one of its transverse sections. In this case also it is possible to minimise the number of closure devices, by means of a suitable arrangement of housings 70.

For the purposes of the present invention, it should also be noted that the variant embodiments presenting one or more transverse extensions 22 allow a further anti-forcing factor to be conferred on the container, because by encircling four faces out of six of the container itself, they hide from sight many lines where different flaps/faces meet edge-to-edge, and in that way prevent anyone being able to insert some thieving implement at such edge-to-edge joints.

Furthermore, still with reference to FIGS. 1*e* and 1*f*, the presence may be noted of complementary flaps 23, which can extend from principal faces 20*a* and/or from transverse extensions 22 and are capable of being folded so as to overlap at least partially with other flaps on the container in operating conditions.

Also a subject of the present invention is an assembly device (indicated in the drawings with the reference number 1), which can conveniently be associated with a container for logistical use of the type described above.

From the structural point of view, this device 1 is operationally active on at least two flaps or laminar elements of such a container (and, more particularly, is operationally activatable between an 'inner flap' which in practice forms an internal wall and an 'outer flap' which contrariwise forms the part of the container directly exposed to the external environment), in order to maintain them in a position of mutual proximity in operating conditions.

It should be observed that, for the purposes of the present description, the 'inner flaps' and/or the 'outer flaps' can be constituted by the already-mentioned principal faces 20 and/or the auxiliary faces 40 of a laminar element 10.

In other words, the assembly devices serve to maintain the shape of the container which has been created, starting from the laminar element 10, once the various 'flaps', which are then constituted by the principal faces and the auxiliary faces of the pre-blanked laminar element, have been suitably folded and brought together in such a way as to form it.

It should be noted that the assembly devices 1 according to the present invention are designed in such a way as to ensure a stable coupling between at least two flaps (for example, with reference to the drawings we may notice a first inner flap 2*a* and a second outer flap 2*b*) constituting a face of container 10, but if the needs of the case require it, it is possible for a single assembly device 1 to interconnect more than one pair of flaps (for example, if it should become necessary to insert an additional panel of cardboard to increase the resistance to the weight of the body being transported).

In accordance with the present invention, assembly device 1 comprises essentially a principal locking element 5, which is irremovably connected to an inner flap 2*a* and is destined to be coupled to at least one outer flap 2*b*.

With a view to further increasing the stability of the connection between the two laminar elements, assembly device 4 also includes a complementary locking element 6: this complementary locking element 6 is operationally active on the outer flap 2*b* in operating conditions, and is intended to engage at least partially on the principal locking element 5.

Advantageously, both the principal locking element 5 and the complementary locking element 6 can be easily produced in plastic (for example, by moulding); it is also possible, in accordance with the present invention, to choose a biodegradable plastic, so as to substantially resolve the problems of environmental impact deriving from a long-term burial (or a cremation) of container 1 which is under discussion.

Coming down to particulars, note that the principal locking element 5 includes a principal stop portion 5*a* (shaped for example in the form of a circular ring) which is designed to be engaged adjacent to a first side of the inner flap 2*a* (which in general is an inner side of the box-type housing body 3). Also present is a principal active portion 5*b*, which extends towards a second side of inner flap 2*a* opposite to the first side (typically, the outer side).

Conveniently, the principal active portion 5*b* is substantially shaped according to a prismatic body having an axis of extension substantially transverse (in practice perpendicular) to the plane in which the inner flap 2*a* lies.

Advantageously, there are present in device 1 sealing means 100 operationally active between the principal locking element 5 and the complementary locking is element 6: these sealing means 100 are irreversibly configurable between a position of first closure of the assembly device in which they bind the principal locking element 5 to the complementary locking element 6 (and consequently ensure that two or more superimposed flaps cannot be separated), and a position in which opening has occurred in which the principal locking element 5 is separated from complementary locking element 6.

It should be noted that the function of the sealing means requires that the sealing means themselves should separate by breakage, corresponding to the condition of opening having occurred: in this way it is possible to verify whether the opening of the container has occurred in violation of the security of said container's contents.

From the structural point of view, sealing means 100 include a first irreversible hooking body 101, insertable into principal locking element 5 (and in its turn, as we have seen above, the principal locking element 5 is manipulated so as to define an insertion direction from inner flap 2*a* towards outer flap 2*b*); there is then a second irreversible hooking body 102, which is however formed in the complementary locking element 6 and designed to engage irreversibly with the first irreversible hooking body 101, at least corresponding to the condition of first closure.

With reference to the attached drawings, the second irreversible hooking body 102 is shaped as a clamping ring, or anyway as a yielding flange (or any functionally and structurally equivalent shape) formed internally to the complementary active portion 6*b*.

From the point of view of putting the sealing means into operation, it may be noted that the first irreversible hooking body 101 is insertable into the principal active portion 5*b* and includes a base 104 and a mushroom-shaped head 103 connected to the base 104, and is in its turn insertable until it stops against the clamping ring.

It should be noted that, according to the sizing of the parts considered above, the separation by breakage of the sealing means can occur through detachment of the mushroom-shaped head from the base and/or through breakage of part or all of the clamping ring.

According to an optional but none the less advantageous characteristic of the present invention, it is possible to provide for the presence of remote means of signalling that a breakage has occurred, which preferably are insertable into the first irreversible hooking body 101 (but also into the ring 102, according to the needs of the moment).

A particularly economical and efficient embodiment of the remote signalling means provides for the presence of a suitable signalling apparatus (which can be a simple transmitter but, if appropriate, can also cover the typical functions of a receiving apparatus or indeed be a receiving and transmitting device) or more generally of an electronic device, capable of transmitting one or more pieces of information to a relative compatible reader, embedded in the mushroom-shaped element 103, and of an antenna connected to it and arranged inside the first irreversible hooking body 101 from the base 104 to the mushroom-shaped element 103: in the event that device 1 is opened, and therefore in the event that is the above-mentioned separation is generated by breakage of the sealing means, the breakage/separation of the mushroom-shaped element 103 from the base 104 will correspond at least to a breakage of the signalling apparatus (or of the electronic device, to put it differently).

The event just described will then be used as a signal for sending a remote transmission to an active detection system.

Depending on the needs of the moment, various methods of monitoring and remote transmission of the closure of the device can then be used: for example, it is possible for the signalling apparatus/electronic device to continue to transmit as long as it remains intact, and for the interruption of the transmitted signal (because of breakage) to indicate the breakage of the sealing means.

On the other hand, it can be possible that in conditions of 'seal intact' (and therefore in conditions of the integrity of the detection device) the signalling apparatus does not emit any signal, but is activated, as mentioned earlier, only when the breakage detecting device is itself 'cleanly' broken from the mushroom-shaped head (or more generally when it is broken from one or more parts of the sealing means).

According to another optional, but none the less advantageous, characteristic of the present invention, it is also possible for the present device to include also, preferably as part of a structure built into the remote signalling means, a so-called 'active' transponder system with the capacity to perform functions of identification and/or multiple activation.

This active transponder can also have the capacity to connect 'permanently' to a telecommunications network for data circulation and handling, so as to enable the possibility of a real exchange in both directions with data collection centres. Advantageously, the active transponder system can be associated with suitable sensor means, with various levels of intelligence and/or capacities for handling qualitative/quantitative data: these sensor means are capable of locally detecting and remotely signalling the elements characterising the condition of attempted violation of the closure and of the perimetral integrity of the container with which the closure device in question is associated, and also of conveying qualitative and/or quantitative information on various identification parameters, traceability and conformity of transport/storage, of the goods contained in it.

According to the needs of the moment, and by way purely of a certainly non-limiting example, the above-mentioned information can include the identifying details of the closure device, the nature and/or the quantity of the goods enclosed in the container, the environmental parameters detectable inside the container, or again the warehouse of origin and the delivery destination (and so forth).

In a particular embodiment of the present invention, the fundamental elements of the system just mentioned are an 'active transponder', preferably of the 'dual-layer' type, attached to the container, which following its awakening in the to presence of a carrier generated by an activator for active transponders (illuminator), which programs its operation and transmits information in accordance with the preset parameters, is capable of storing the data received from the illuminator and is activated according to the modalities of operation dictated by the parameters received, and transmits an identification code of its own (which may be denoted by the acronym 'ID') and other information to a receiving unit (receiver).

In its turn, the receiver remains permanently on the radio channel, receiving data transmitted by the active transponder, and when it receives valid information it transmits it, according to programmable and parametrisable modalities of operation, to a telecommunications network to which it is connected, by means of the communications interfaces provided.

In this way it is possible to establish an interaction between an 'intelligent environment', pervaded by a technological infrastructure composed of a multiplicity of activation/transmission and data reception devices, which can be advantageously installed at the logistical centres and/or on vehicles which are travelling along the distribution chain of a particular operator: in this intelligent environment, therefore, there are operating one or more transponder systems (in their turn fitted to one or more containers), thus enabling the exchange of data in real time between a management software and the transponders themselves, thus making it possible to automate and optimise the various processes of management and control of the entire logistical link of the distribution chain.

Still by way of non-limiting example, the effects of automation and optimisation can concern: the correspondence of the activity of 'packaging' the order with the 'picking list', the correct loading sequence for the transporting vehicle, the readjustment of the warehouse and so forth.

To understand in full the potential of the solution just described, it may prove useful to consider some application examples.

The picking of the goods in the warehouse and their packing for despatch are is performed on the basis of a given 'picking list' for an order and can be managed by the use of so-called 'tags' (in other words, passive transponders) placed on each product for identification. Once all the products have been picked on the basis of the picking list for the order, the closure system is attached to the container and closed up.

A suitable illuminator is used to activate the active transponder of the closure system, which, following the receipt of the information transmitted by the illuminator, is configured according to the modalities of operation dictated, and begins to transmit the specified data at regular intervals.

At the same time a gateway equipped with a tag reader is automatically activated, which detects the nature and quantity of the products which have been put into the container, allowing the management software to verify the correspondence between the 'picking list' for the order and the goods which have been packed (if required, the 'picking list' can be stored in the active transponder). A warning signal reports any non-correspondence.

The parcel just produced is deposited in the despatch area to await despatch, and the receiver which is positioned to cover the area in question receives the information transmitted by the active transponder and updates the location details and any status parameters of the container in the management software. Subsequently, the container is loaded onto a motor vehicle to be delivered. All the vehicles are equipped with receivers interfaced with satellite locating systems, which in turn are connected, for example by means of wireless communications systems, to a telecommunications network (which can be a dedicated network or can also be the internet).

The information transmitted by the active transponder is now received by the receiver of the motor vehicle and the location data and any status parameters of the container are then updated in the management software.

At the end of the loading operation the management software confirms to the operator and to the driver that the operation has been concluded correctly. A signal gives a warning in the event that errors have occurred.

During transportation, the information received by the receiver on the vehicle is stored on board and transferred continuously to the management software, either according to programmed spatio-temporal parameters, or on request and/or in case of any irregularity.

When the containers are unloaded and positioned in the destination warehouse, the receiver which is located so as to cover the area receives the information transmitted by the active transponder, and updates the management software.

When the operation has been completed, the system confirms to the operator and to the driver that the operation has been concluded correctly. A signal gives a warning in the event that errors have occurred.

Again by analysis of the drawings it may be seen that the prismatic body described above includes a clamping body 7, formed laterally on the prismatic body and designed to engage irremovably with inner flap 2*a* in operating conditions; in other words, the clamping body 7 directly brings about the condition of irremovable constraint between the principal locking element 5 and the inner flap 2*a*.

In practice, the bringing-about of the irremovable constraint is guaranteed by the particular conformation of clamping body 7 itself: in fact it is substantially conformed like a ratchet tooth.

In particular, the clamping body 7 presents an insertion surface 7*a* (oriented according to a predetermined insertion angle 8 with respect to the longitudinal axis of extension of the prismatic body) and a striking surface 7*b* connected to the insertion surface 7*a* (oriented however along a direction perpendicular to the axis of longitudinal extension of the prismatic body itself).

During the assembly of container 1, an operator acts in such a way as to force the cylindrical body through suitable openings (which in practice are the housings 23 described below) formed in the inner flap 2*a*; when this is done, the clamping body 7 enters progressively into the inside of the cardboard, in such a way as to make its accidental release almost impossible.

Advantageously, to obtain the maximum symmetry of behaviour, the principal active portion 5*b* comprises a predetermined number of clamping bodies 7, equally spaced radially around the prismatic body at a predetermined distance from the stop portion 5*a* (in FIG. 3 it is possible for example to note 4 clamping bodies 7 located at 90° from each other and all positioned at the same height with respect to the stop portion 5*a*).

Advantageously, the principal active portion 5*b* also includes mechanical restraining means, which are formed on the prismatic body and are designed to engage with the complementary locking element 6 in operating conditions. In particular, these mechanical restraining means include a thread 9, which extends laterally from the prismatic body and operates according to modalities which will be explained in greater detail further on.

In accordance with the present invention, the complementary locking element 6 includes (analogously to the principal locking element 5) a complementary stop portion 6*a*, destined to engage adjacently to a first surface of the outer flap 2*b*, and a complementary active portion 6*b* extending towards a second surface of outer flap 2*b* (typically, towards the inside of the box-type housing body 3). It should at this point be stated that, in operating conditions (i.e. when container 1 is completely assembled), the above-mentioned second surface of the outer flap 2*b* is located practically opposite the first surface of the outer flap 2*b*; obviously, the second surface of outer flap 2*b* and the second side of inner flap 2*a* are in mutual contact in operating conditions.

The complementary active portion 6*b* conveniently includes interconnection means designed to engage with the mechanical restraining means on the principal active portion 5*b*; in particular, these interconnection means include a hollow prismatic body extending from the complementary stop portion 6*a* and presenting on its interior a helicoidal 'female' thread-groove 10 substantially counter-profiled to thread 9 (which in its turn may be defined as a 'male thread').

In the execution of the operations of assembling container 1, after inserting the principal locking element 5 irremovably into the inner flap 2*a* and after bringing the inner flap 2*a* itself into proximity with the outer flap 2*b*, the operator proceeds to mutually engage the principal locking element 5 with the complementary locking element 6, typically by screwing the thread 9 into the helicoidal thread-groove 10.

With a view to facilitating bringing inner flap 2*a* into proximity with outer flap 2*b*, there can advantageously be present introducing means 11, which are connected to the principal locking element 5.

These introducing means 11 are operationally active on the principal locking element 5 to determine, or in other words facilitate, bringing the inner flap 2*a* into proximity with the outer flap 2*b*.

The introducing means 11 are made up substantially of a traction body 11*a* connected to the principal active portion 5*b*; this traction element 11*a* is conveniently activated by an operator (during the operations of assembling container 1) to bring inner flap 2*a* into proximity with outer flap 2*b*; in other words, the operator, after inserting the principal locking element 5 draws it outwards using the traction body 11*a* itself, in order to bring together all the components constituting the container to be assembled.

In a preferred embodiment, traction body 11*a* is simply a threadlike element, which has a first end connected to the principal stop portion 5*a* and a second end (opposite to the first end) presenting an activating interface 12 (typically, a body of any shape whatsoever provided that it is capable of being gripped and manipulated by an operator in operating conditions).

An advantageous variant embodiment relating to traction body 11*a*, however, specifies that this should be a rigid element 12; this rigid element 12 has a first end pivoting on the complementary stop portion 6*a* (for example around a pivoting axis substantially parallel to the plane in which the outer flap 2*b* lies), and a second end opposite to the first end.

On the second end of the rigid element 12 there is a shaped grip 13 (which can properly be designated a handle) designed to be grasped by a user's hand.

The presence of such a rigid element 12 has a useful application in the event that it is desired to equip container 1 with a series of carrying handles; in this case, container 1 itself includes a predetermined number of coupled assembly devices 14 (fitted to the laminar elements 2 forming the lateral walls of the box-type housing body 3), each of which presents at least two principal locking elements 5 (connected to an inner flap 2*a*, distanced from each other by a predetermined spacing and advantageously destined to be coupled to at least one second laminar element 2, preferably one for each of the two elements 5).

Advantageously, this pair of principal locking elements 5 is associated (at the stage of assembling container 1) with two complementary locking elements 6, each of which engages respectively with the principal locking elements 5, and which are equally equipped with two rigid elements 12, which in their turn present their first ends pivoting respectively on the complementary locking elements 6 and their second ends mutually connected by a grip 13.

In this case, grip 13 extends between the rigid elements 12 for a length substantially corresponding to the spacing described above, so as to form a handle which is positioned moreover in such a way as to allow an operator to easily lift container 1 when standing at one side.

Conveniently, the container according to the present invention includes furthermore a predetermined number of housings 23 (obviously formed in the manner most suitable to the needs of the moment in the various laminar elements 2), each of which is designed to receive an assembly device 4.

Conveniently, to position appropriately the latter variant of the assembly device just described, suitable housings can be prearranged in laminar element 10.

The invention enables important advantages to be achieved.

First of all, it should be noted that the peculiar constructional architecture of the laminar element, and more particularly the prearranging of suitable offsets for adjacent edges and/or folding lines allows a perfect flat surface to be formed at the stage of assembly and superimposition of the flaps, as well as perfect perpendicularity between the various faces of the container itself: in this way not only is any interference between the flaps eliminated, but also an external surface is formed which is completely flat and free of gaps or raised points.

At the same time, also the closure device described above (and claimed below) presents a notable anti-forcing capacity, or at least renders an attempted forcing (which can even be executed by the personnel of a logistical operator themselves) so obvious as to make it unattractive in practice.

From the point of view of the optional capacities which may be implemented for the closure device, it may be observed that this device does not necessarily have to be placed in proximity to suitable readers (as is however the case with magnetic strips) and (unlike a bar-code) does not even have to be located on a visible surface area of the parcel.

If so desired, it is even possible to add information on the chips embedded in the closure device or devices, which may vary quantitatively and/or qualitatively depending on the type of chip (Read Only, Read Once, Read and Write).

Furthermore, the possibility of inserting an 'active' device which communicates in real time the occurrence of forcing or at all events the breakage of the seal is enables the implementation at extremely low cost of additional functionality which is certain to be of interest.

Finally, it must be noted that the present invention enables the manufacture both of the container in cardboard (or similar material) and of the closure device at low costs of production and sale, besides allowing rapid and easy manipulation even by operators who are not particularly skilled (which all impacts advantageously on handling and processing costs within logistical operators).

The invention claimed is:

1. An assembly device (1) associable with containers for logistical use, comprising:

a principal locking element (5) irremovably connectable to an inner flap (2*a*) of a container realisable by folding a laminar element (10), said principal locking element (5) being designed to enable the coupling of said inner flap (2*a*) with at least one outer flap (2*b*) of said container at least partially superimposable on said inner flap (2*a*) of the container itself;

a complementary locking element (6) activatable on said outer flap (2*b*) in operating conditions and designed to engage at least partially with the principal locking element (5);

a principal active portion (5*b*) of the principal locking element (5), said principal active portion (5*b*) presenting mechanical restraining means extending towards the outer flap (2*b*) of the container in assembly conditions and designed to engage with the complementary locking element (6); and a complementary active portion (6*b*) of the complementary locking element (6), said complementary active portion (6*b*) presenting interconnection means extending towards the inner flap (2*a*) of the container in assembly conditions and designed to engage with the mechanical restraining means of the principal active portion (5*b*);

sealing means (100) operationally active between the principal locking element (5) and the complementary locking element (6) and irreversibly configurable between a condition of first closure of the assembly device in which said sealing means bind the principal locking element (5) to the complementary locking element (6), and a condition of opening having occurred in which the principal locking element (5) is separated from the complementary locking element (6), said sealing means being separated by breakage, this corresponding to said condition of opening having occurred and including:

a first irreversible hooking body (101) insertable into the principal locking element (5), a direction of said insertion being from the inner flap (2*a*) towards the outer flap (2*b*); and a second irreversible hooking body (102) formed in the complementary locking element (6) and designed to engage irreversibly with said first irreversible hooking body (101), this corresponding at least to the condition of first closure.

2. A device according to claim 1, characterised in that said second irreversible hooking body (102) is conformed according to a clamping ring formed internally to the complementary active portion (6*b*).

3. A device according to claim 1, characterised in that the first irreversible hooking body (101) is insertable into the principal active portion (5*b*) and includes a base (104) and a mushroom-shaped head (103) connected to said base (104) and insertable until it meets a stop into said clamping ring.

4. A device according to claim 1, characterised in that it comprises means of signalling the occurrence of a breakage of the sealing means, said means being insertable in the first irreversible hooking body (101).

5. A device according to claim 4, characterised in that said signalling means comprise a signalling apparatus embedded in the base (104) and a breakage detecting device, connected to said signalling apparatus and arranged inside the first irreversible hooking body (101) from the base (104) to the mushroom-shaped element (103), a breakage and/or a separation corresponding at least to a breakage of said breakage detecting device.

6. A device according to claim 1, characterised in that said mechanical restraining means comprise a male thread (9), said interconnection means comprising a hollow prismatic body having inside it a helicoidal female thread-groove (10) substantially counter-profiled to the male thread (9).

7. A device according to claim 1, characterised in that the principal locking element comprises also a principal stop portion (5*a*) designed to engage adjacently to a first face of the inner flap (2*a*), the principal active portion (5*b*) extending towards a second face of the inner flap (2*a*) opposite to said first face.

8. A device according to claim 1, characterised in that said principal active portion (5*b*) is substantially profiled according to a prismatic body having an axis of extension substantially transverse, perpendicular to the plane in which the inner flap (2*a*) lies, said prismatic body comprising at least one clamping body (7) formed laterally on said prismatic body and designed to be irremovably engaged with the inner flap (2*a*) in operating conditions.

9. A device according to claim 1, characterised in that said clamping body (7) has an insertion surface (7*a*) oriented according to a predetermined insertion angle (8) with respect to the longitudinal axis of extension of the prismatic body and a striking surface (7*b*) connected to said first insertion surface (7*a*) and oriented substantially along a direction perpendicular to the longitudinal axis of extension of the prismatic body.

10. A device according to claim 1, characterised in that the principal active portion (5*b*) comprises a predetermined number of clamping bodies (7) located radially equidistant around the prismatic body and placed at a predetermined distance from said stop portion (5*a*).

11. An assembly device according to claim 1, characterised in that the complementary locking element (6) comprises a complementary stop portion (6*a*) designed to engage adjacently to a first surface of the outer flap (2*b*), the complementary active portion (6*b*) extending towards a second surface of the outer flap (2*b*), said second surface of the outer flap (2*b*) being opposite to said first surface of the outer flap (2*b*), the second surface of the outer flap (2*b*) and the second face of the inner flap (2*a*) being mutually in contact in operating conditions.

12. An assembly device according to claim 1, characterised by furthermore comprising introducing means (11) connected to the principal locking element (5) and operationally active on the latter to bring about a proximity of the inner flap (2*a*) to the outer flap (2*b*).

13. An assembly device according to claim 12, characterised in that said introducing means (11) include a traction body (11*a*) connected to the principal active portion (5*b*) and designed to be activated by an operator in order to bring the inner flap (2*a*) into proximity with the outer flap (2*b*).

14. An assembly device according to claim 13, characterised in that said traction body (11*a*) is a threadlike element having a first end connected to the principal stop portion (5*a*) and a second end opposite to said first end and presenting an activating interface (12) designed to be manipulated by the operator in operating conditions.

15. An assembly device according to claim 13, characterised in that the traction body (11*a*) is a rigid element (12) having a first end pivoting on the complementary stop portion (6*a*) around a pivoting axis which is substantially parallel to the plane in which the outer flap (2*b*) lies, and a second end opposite to the first end, having a profiled grip (13) designed to be grasped by the hand of the user.

16. An assembly device according to claim 1, characterised in that it comprises a predetermined number of coupled assembly devices (14), each of which has:

at least two principal locking elements (5) connected to a first inner flap (2*a*) and mutually distanced by a predetermined spacing and designed to be coupled to at least one outer flap (2*b*);

at least two complementary locking elements (6) engaging respectively the principal locking elements (5); and at least two rigid elements (12) having first ends pivoting respectively on the complementary locking elements (6) and second ends mutually connected by a grip (13), said grip (13) extending between the rigid elements (12) for a distance substantially corresponding to said spacing.

* * * * *